United States Patent [19]

Backlund

[11] 4,407,351

[45] Oct. 4, 1983

[54] METHOD FOR HEAT ABSORPTION FROM A SEA BOTTOM OR THE LIKE

[75] Inventor: Erik L. Backlund, Frösön, Sweden

[73] Assignee: Forenade Fabriksverken, Eskilstuna, Sweden

[21] Appl. No.: 370,816

[22] Filed: Apr. 22, 1982

[30] Foreign Application Priority Data

Apr. 24, 1981 [SE] Sweden ..... 8102618

[51] Int. Cl.[3] ..... F28F 13/14

[52] U.S. Cl. ..... 165/1; 62/260; 138/32; 165/45; 165/135; 405/157; 405/172

[58] Field of Search ..... 165/45, 1, 135; 60/641.7; 138/32, 114; 62/260; 405/157, 172, 130

[56] References Cited

U.S. PATENT DOCUMENTS

| | | | |
|---|---|---|---|
| 1,761,281 | 6/1930 | Taub | 138/114 |
| 2,773,513 | 12/1956 | Isenberg | 165/45 X |
| 3,777,502 | 12/1973 | Michie et al. | 165/45 X |
| 3,807,183 | 4/1974 | Wolff | 405/157 |
| 4,192,630 | 3/1980 | Duthweiler | 62/260 X |

FOREIGN PATENT DOCUMENTS

| | | | |
|---|---|---|---|
| 1064272 | 10/1979 | Canada | 405/157 |

*Primary Examiner*—Sheldon J. Richter

*Attorney, Agent, or Firm*—Cushman, Darby & Cushman

[57] ABSTRACT

In order to prevent a conduit for heat absorption from a sea bottom or the like to float up in wintertime from the bottom due to icing, it is proposed according to the invention that the flow cross-section of the conduit is heat insulated from the surrounding water. Such insulation is obtained according to one embodiment of the invention, in that a work fluid is imparted with a laminar flow in the upper cross-section (15) of the conduit by means of a constricting inner pipe (12) located upwardly in the conduit, while the work fluid in the remaining cross-section (16) is permitted to have a turbulent flow.

1 Claim, 4 Drawing Figures

METHOD FOR HEAT ABSORPTION FROM A SEA BOTTOM OR THE LIKE

This invention relates to a method and a system at the absorption of heat from a sea bottom or the like where heat from the bottom is emitted via a conduit to a flowing work fluid.

Heat absorbing systems such as heat pump installations for the recovery of low-grade sea heat normally require great capital investments in relation to the recoverable energy amount. In order to reduce to the greatest possible extent these costs, it is desired to design simple structures of inexpensive materials. Conduits and the like for the absorption and transport of the heat normally are manufactured of plastic materials.

One usual problem involved with conduits of this kind laid down in lakes and water-courses is the risk of ice formation on the conduits in wintertime. In order to prevent the conduits from floating up, therefore, they must be anchored in the sea bottom, which implies additional costs.

The present invention has the object to render it possible to lay down a conduit freely, for example on a sea bottom, at low cost and in a simple way, without risk that the conduit will flow up due to icing.

This object is achieved, in that the invention has been given the characterizing features defined in the attached claims, where it is proposed at a method according to the invention, that the flow cross-section of the fluid is heat insulated from the surrounding water. Ice formation on the conduit is hereby prevented, or in any case restricted to a lower portion on the conduit, so that this portion can freeze fast on the bottom before the conduit due to said ice formation tends to float up.

The heat insulation can be brought about especially in that a laminar flow—with small heat convection across the flow direction—is imparted by suitable measures to the fluid in one or more portions of the flow cross-section, which portions preferably are located upwardly and adjacent to the surrounding water, while the fluid flow in the remaining cross-section is turbulent—with great heat convection across the flow direction.

This division of the flow is achieved in that the cross-section of the conduit shows one or several narrow portions, which are located upwardly, and one wide portion, which is located downwardly. In said narrow portions both the characteristic length and the flow rate in Reynold's relation (Reynold's number=flow rate times characteristic length divided through kinematic viscosity) are small and, respectively, low, which results in a low Reynold's number, whereby the flow in the narrow portions remains laminar even at a through flow giving rise to turbulent flow in the remaining wide portion of the cross-section.

Figure 1:
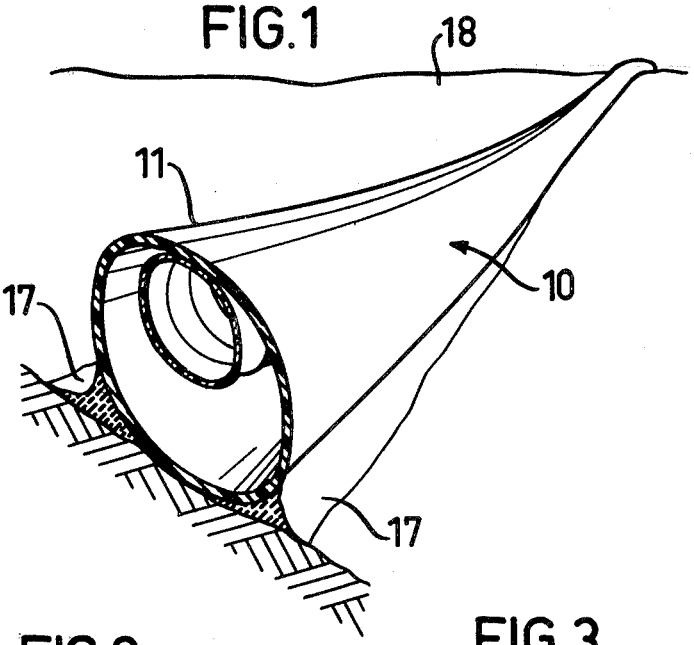
Figure 2:
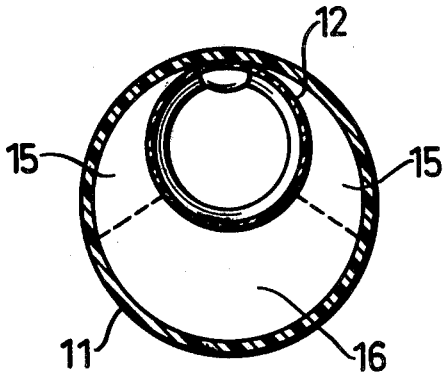
Figure 3:
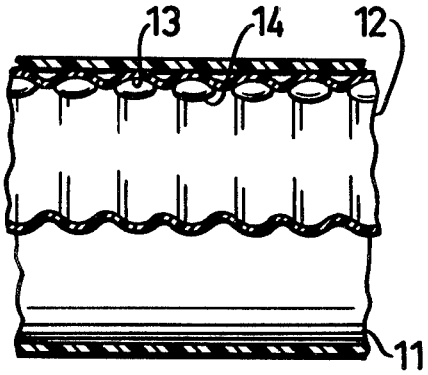
Figure 4:
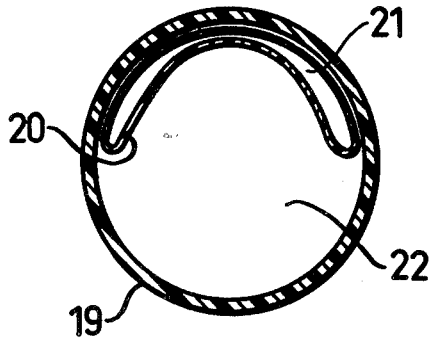

Embodiments of the invention are described in greater detail in the following, with reference to the accompanying drawing, in which FIG. 1 shows a section of a conduit according to the invention which in wintertime is frozen fast on a sea bottom, FIGS. 2 and 3 are cross-section and, respectively, longitudinal section of a conduit according to FIG. 1, and FIG. 4 is a cross-section of a conduit according to a second embodiment of the invention.

The conduit 10 according to the invention is intended to be positioned in a manner known per se on the bottom of a lake, river, bay or the like. From the bottom and surrounding bottom water heat is emitted to a work fluid, for example an aqueous solution of calcium chloride, which flows in a circuit in the conduit and transports the heat to a heat absorbing device, for example a heat pump or the like.

The conduit shown in FIGS. 1–3 comprises an outer pipe 11 and an inner pipe 12, both of which may be manufactured of some suitable plastic material, for example HD or LD polyethylene. The inner pipe 12, the diameter of which is about or somewhat more than half the diameter of the outer pipe, abuts in operative position the upper inner surface of the outer pipe by means of buoyancy. At the embodiment shown, the buoyancy is obtained in that the inner pipe is corrugated, in such a manner that air bubbles from the work fluid or from the originally air-filled inner pipe are caught beneath wave crests 13 in the upper portions of the inner pipe according to FIG. 3, so that the inner pipe always will be in an upper position in the outer pipe 11, due to the buoyancy of the air bubbles 14. The inner pipe may be a thin corrugated pipe, for example of cable protection pipe type. The necessary buoyancy may also be obtained from a float line or the like (not shown), which is drawn through a smooth uncorrugated inner pipe.

The transported fluid flows substantially only in the conduit cross-section outside the inner pipe 12; which preferably is closed at least at one end and need not necessarily be entirely sealed, but may permit a certain inflow of the flowing fluid.

Owing to the fact that the inner pipe 12 is located upwardly in the conduit, a flow cross-section is obtained which has two narrow portions 15 located upwardly at the sides of the inner pipe, and a wide portion 16, which is defined approximately (depending on the flow rate and diameter ratio) at the dashed lines in FIG. 2. At the flow through the conduit the flow rate and characteristic length in the aforesaid Reynold's relation will be lower and, respectively, smaller in the narrow portions 15 than in the wide portion 16. As a result thereof, a laminar flow can be maintained in the narrow portions at a flow rate, which in the wide portion gives rise to a turbulent flow.

At laminar flow no material is transported across the flow direction and, therefore no heat is transported, either, across the flow direction. This implies that the fluid in the upper portions 15 partially heat insulates the lower portion 16 (with turbulent flow and great heat convection across the flow direction) from the surrounding water.

It can also be imagined to bring about a division into laminar flow and turbulent flow by means of a pipe having a smooth inner surface in its upper portion and a rough inner surface in its lower portion.

In wintertime when the bottom temperature, particularly in shallow water, may be close to zero, ice forms on the immersed conduits, due to the fact that the bottom and surrounding water locally are cooled at heat emittance to the flowing work fluid. This ice formation not only deteriorates heat absorption, but it also implies the risk that a conduit laid down freely will float up together with the ice, which is of a lower weight in relation to the water.

The upper portions 15 of the conduit insulate the cold turbulent work fluid flow in the lower portion 16 from the surrounding water above the outer pipe 11. Due to the turbulent flow of the cold work fluid in the lower portion 16, the lower outer surface of the outer pipe 11 will be colder than the upper outer surface thereof. At low bottom temperature, therefore, ice 17 forms only in the lower zone of the outer pipe, substantially as shown in FIG. 1, so that this zone freezes fast on the bottom 18 of the water-course.

The necesssary heat insulation can be adjusted in a simple way so as to agree with the prevailing water temperature, in that the extension of the laminar portions 15 is varied by changing the flow rate. By means of a high flow rate the turbulent portion 16 can be extended to the greater part of the flow cross-section, with small or no risk of icing.

At the above embodiment also the work fluid standing still in the inner pipe 12 contributes to some extent to the heat insulation against surrounding water. In the following an alternative embodiment is described which utilizes only this type of insulation.

In FIG. 4 a cross-section of a conduit is shown which is partially heat insulating upward and to the sides. The outer pipe 19 is of the same type as the outer pipe 11 in FIGS. 1–3, while the insulating inner pipe 20 consists of a soft pipe with low density. The inner pipe 20, which in an original state has a slightly smaller diameter than the outer pipe 19, is deformed by the pressure of the work fluid and assumes substantially kidney shape when the conduit is being filled. The cross-section 21 of the deformed inner pipe 20, like the cross-section of the inner pipe 12, can be filled with the work fluid standing still, or it possibly may be flown through in a laminar way by the same. In both cases a small convective portion of the heat transfer from the water to the turbulent fluid flow in the cross-section 22 is obtained, whereby this cross-section partially is heat insulated from the surrounding water with the same effect as the conduit according to FIGS. 1–3.

The embodiments described above can be modified in many different ways within the scope of the attached claims. The inner pipe, for example, can be replaced by an oblong cylindric body of a porous material floating on the work fluid. The insulation can also be effected by a layer of insulation material applied to the upper inner or outer surface of the outer pipe 11.

What I claim is:

1. A method of heat absorption by means of a pipe conduit laid down on a sea bottom or the like, wherein heat from the bottom and the ambient water is emitted to a working fluid in the conduit, wherein in order to prevent said conduit from floating up from said bottom due to ice-formation, one or more upper or lateral portions of the flow cross-section are heat-insulated against the ambient water, so that ice-formation, if present, is restricted to the bottom side of said conduit to freeze fast said conduit to the bottom, wherein the heat insulation is achieved in that the working fluid in the conduit is caused to stand-still or imparted with a laminar flow in said upper and lateral portions of the flow cross-section and imparted with a turbulent flow in the remaining portion of the flow cross-section.

* * * * *